US011638988B2

(12) United States Patent
Hsieh

(10) Patent No.: US 11,638,988 B2
(45) Date of Patent: May 2, 2023

(54) ELECTRONIC WRENCH AND PROMPTING METHOD THEREOF

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 368 days.

(21) Appl. No.: 17/133,664

(22) Filed: Dec. 24, 2020

(65) Prior Publication Data

US 2021/0260737 A1 Aug. 26, 2021

(30) Foreign Application Priority Data

Feb. 24, 2020 (TW) ..... 109105898

(51) Int. Cl.
*B25B 23/142* (2006.01)

(52) U.S. Cl.
CPC ..... *B25B 23/1425* (2013.01)

(58) Field of Classification Search
CPC ..... B25B 23/1425; B25B 23/1475; B25B 23/1453; B25B 23/1427
See application file for complete search history.

(56) References Cited

U.S. PATENT DOCUMENTS

2019/0283196 A1* 9/2019 Shao ..... G01S 17/87
2020/0164496 A1* 5/2020 Hsieh ..... B25B 23/1425
2021/0260737 A1* 8/2021 Hsieh ..... B25B 23/1425

* cited by examiner

*Primary Examiner* — Lee D Wilson
(74) *Attorney, Agent, or Firm* — CKC & Partners Co., LLC

(57) ABSTRACT

An electronic wrench includes a main body, at least one sensing element, a processor and at least one prompting unit. The sensing element is configured to sense a working status of a working head to generate a sensing signal, and the sensing signal includes at least one sensing information value. The processor includes a first prompt lower limit value and a second prompt lower limit value. The prompting unit is configured to provide at least one working status prompt. When the sensing information value is less than or equal to the first prompt lower limit value, the working status prompt is visible in a first numeric display format. When the sensing information value is greater than the first prompt lower limit value and less than or equal to the second prompt lower limit value, the working status prompt is visible in a second numeric display format.

10 Claims, 7 Drawing Sheets

ELECTRONIC WRENCH AND PROMPTING METHOD THEREOF

RELATED APPLICATIONS

This application claims priority to Taiwan Application Serial Number 109105898, filed Feb. 24, 2020, which is herein incorporated by reference.

BACKGROUND

Technical Field

The present disclosure relates to an electronic wrench and a prompting method thereof. More particularly, the present disclosure relates to an electronic wrench and a prompting method thereof applicable to clearly judge an interval of a torque value.

Description of Related Art

In general, most of electronic wrenches on the market have a function of sensing a torque value and an angle value. However, the torque value and the angle value are only numerically displayed on monitors of the electronic wrenches on the market. Hence, an interval of the torque value at the moment cannot be learned before a user carefully reads the torque value.

Hence, a development of an electronic wrench and a prompting method thereof, which can be configured to facilitate the user to judge the interval of the torque value via different numeric display formats, is a future trend of an industry thereof.

SUMMARY

According to one aspect of the present disclosure, an electronic wrench includes a main body, at least one sensing element, a processor and at least one prompting unit. The main body includes a working head. The sensing element is disposed on the main body, the sensing element is configured to sense a working status of the working head to generate a sensing signal, and the sensing signal includes at least one sensing information value. The processor is electrically connected to the sensing element, and the processor includes a first prompt lower limit value and a second prompt lower limit value. The prompting unit is electronically connected to the processor, and the prompting unit is configured to provide at least one working status prompt. When the sensing information value is less than or equal to the first prompt lower limit value, the working status prompt is visible in a first numeric display format, and a range of the first numeric display format has a first allowable error value. When the sensing information value is greater than the first prompt lower limit value and less than or equal to the second prompt lower limit value, the working status prompt is visible in a second numeric display format, and a range of the second numeric display format has a second allowable error value. The first numeric display format is different from the second numeric display format.

According to another aspect of the present disclosure, a prompting method of an electronic wrench includes an operating step, a sensing step and a comparing step. In the operating step, a working head of the electronic wrench is operated on a workpiece. In the sensing step, a working status of the working head is sensed via at least one sensing element to generate a sensing signal, and the sensing signal includes at least one sensing information value.

In the comparing step, the sensing information value is compared to a first prompt lower limit value and a second prompt lower limit value to provide a working status prompt. When the sensing information value is less than or equal to the first prompt lower limit value, the working status prompt is a first numeric display format, and a range of the first numeric display format has a first allowable error value. When the sensing information value is greater than the first prompt lower limit value and less than or equal to the second prompt lower limit value, the working status prompt is a second numeric display format, and a range of the second numeric display format has a second allowable error value.

DETAILED DESCRIPTION

Figure 1:
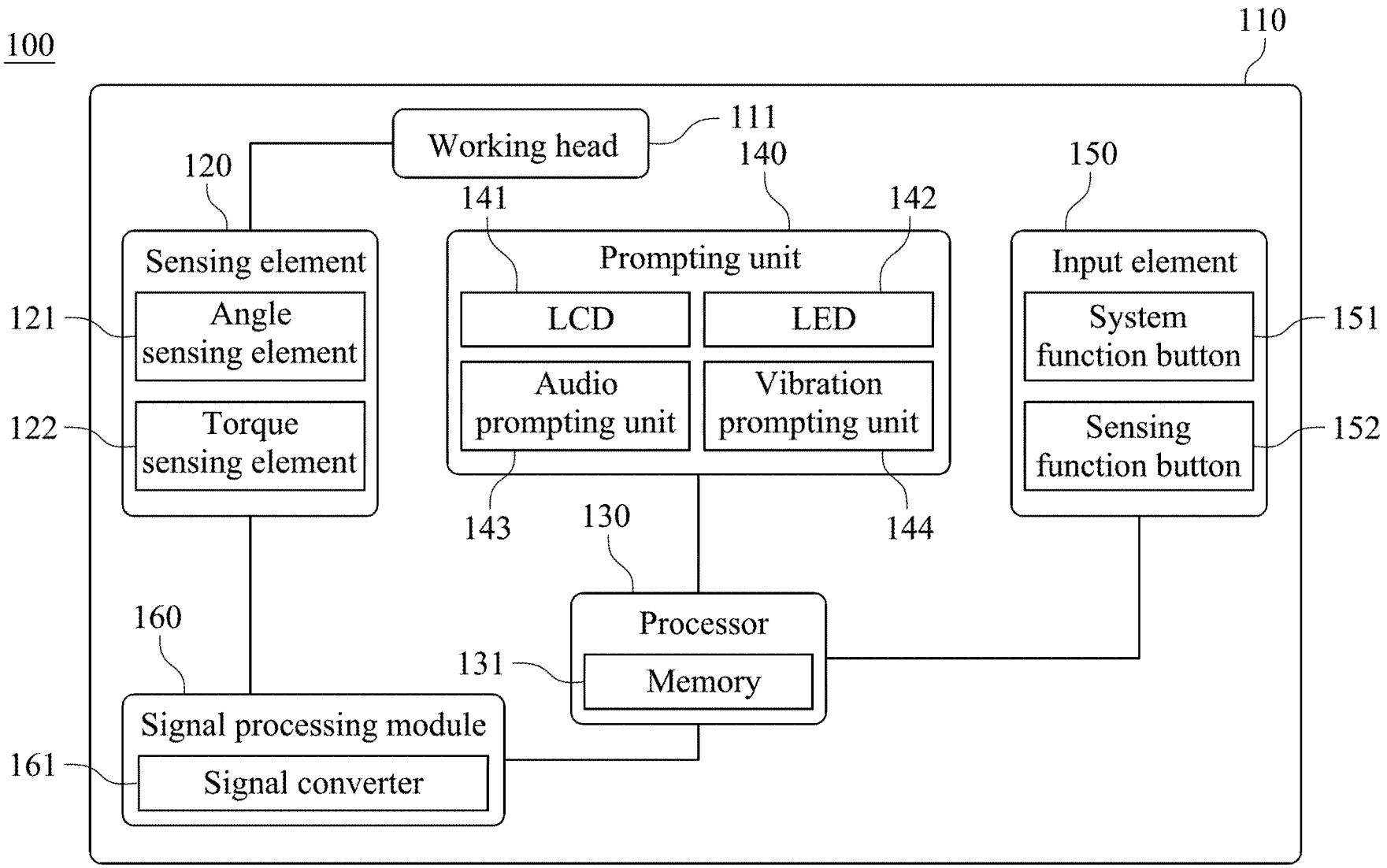
FIG. 1 is a block diagram of an electronic wrench according to an embodiment of the present disclosure.

FIG. 1 is a block diagram of an electronic wrench 100 according to an embodiment of the present disclosure. In FIG. 1, the electronic wrench 100 includes a main body 110, at least one sensing element 120, a processor 130, at least one prompting unit 140, an input element 150 and a signal processing module 160.

In detail, the main body 110 includes a working head 111. The sensing element 120 is disposed on the main body 110, and the sensing element 120 is configured to sense a working status of the working head 111 to generate a sensing signal. The sensing signal includes at least one sensing information value. The processor 130 is electrically connected to the sensing element 120, and the processor 130 includes a first prompt lower limit value and a second prompt lower limit value. The prompting unit 140 is electronically connected to the processor 130, and the prompting unit 140 is configured to provide at least one working status prompt.

The sensing element 120 at least can include an angle sensing element 121 or a torque sensing element 122, and the sensing information value at least can include an angle sensing value or a torque sensing value. In particular, according to the embodiment of FIG. 1, the sensing element 120 includes the angle sensing element 121 and the torque sensing element 122. That is, the angle sensing value and the torque sensing value can be provided via the electronic wrench 100.

To provide a selecting function of the electronic wrench 100 for a user, the electronic wrench 100 can further include at least one of the input element 150 electronically connected to the processor 130, wherein the input element 150 can be a physical button or a touch button. In particular, according to the embodiment of FIG. 1, the input element 150 can include a system function button 151 and a sensing function button 152. The user can select a plurality of performing functions of the electronic wrench 100 via the system function button 151, such as a turn-on status, a turn-off status, a standby status or a reset status. The system function button 151 can be composed of a single button or a plurality of buttons according to different demands. When the system function button 151 is composed of the plurality of buttons, the buttons can include a turn-on button (not shown), a turn-off button (not shown), a standby button (not shown) or a reset button (not shown). When the user presses the turn-off button, all power of the electronic wrench 100 is turned off via the processor 130 to transform to the turn-off status; when the user presses the standby button, a portion of the power of the electronic wrench 100 is turned off via the processor 130 to transform to the standby status; when the user presses the reset button, the electronic wrench 100 is reset via the processor 130 to resume to an initialization. The aforementioned functions of the buttons are not limited thereto.

The user can select a sensing function of the electronic wrench 100 via the sensing function button 152, and then a hardware circuit is detected to perform the sensing function via the electronic wrench 100, such as an angle sensing function or a torque sensing function. The sensing function button 152 can be composed of a single button or a plurality of buttons according to different functions. When the sensing function button 152 is composed of the plurality of buttons, the buttons can include an angle sensing button (not shown) or a torque sensing button (not shown). When the user presses the angle sensing button, an angel of the working head 111 is sensed via the sensing element 120 to generate the sensing signal; when the user presses the torque sensing button, a torque of the working head 111 is sensed via the sensing element 120 to generate the sensing signal. The aforementioned functions of the buttons are not limited thereto.

The signal processing module 160 is electronically connected to the processor 130 and the sensing element 120. The sensing signal generated via the sensing element 120 is received and processed via the signal processing module 160, and then the sensing signal processed is transferred to the processor 130. The sensing signal can be an analog sensing signal or a digital sensing signal, and the signal processing module 160 can include a signal converter 161 and an amplifier (not shown). That is, when the sensing signal is the analog sensing signal, the sensing signal can be converted from the analog sensing signal to the digital sensing signal via the signal converter 161 and then transferred to the processor 130, or the sensing signal can be amplified via the amplifier, the analog sensing signal is converted to the digital sensing signal via the signal converter 161, and then the digital sensing signal is transferred to the processor 130.

In detail, when the sensing information value is less than or equal to the first prompt lower limit value, the working status prompt is visible in a first numeric display format, and a range of the first numeric display format has a first allowable error value; when the sensing information value is greater than the first prompt lower limit value and less than or equal to the second prompt lower limit value, the working status prompt is visible in a second numeric display format, and a range of the second numeric display format has a second allowable error value. The first numeric display format is different from the second numeric display format. Therefore, the user can directly judge an interval of a torque value by a difference between the first numeric display format and the second numeric display format.

Further, the processor 130 can further include a prompt upper limit value. When the sensing information value is greater than the second prompt lower limit value and less than or equal to the prompt upper limit value, the working status prompt is visible in a third numeric display format. A range of the third numeric display format can have a third allowable error value, and the third numeric display format can be different from the first numeric display format and the second numeric display format value. In particular, the third allowable error value can be less than the second allowable error value, and the second allowable error value can be less than the first allowable error value. That is, a precision of the range of the third numeric display format is higher than a precision of a range of the second numeric display format, and the precision of the range of the second numeric display format is higher than a precision of a range of the first numeric display format. In detail, at least one of a font form, a font color, a background color, a font size and a font effect of the first numeric display format can be different from at least one of a font form, a font color, a background color, a font size and a font effect of the second numeric display format, the at least one of the font form, the font color, the background color, the font size and the font effect of the first numeric display format can be different from at least one of a font form, a font color, a background color, a font size and a font effect of the third numeric display format, and the at least one of the font form, the font color, the background color, the font size and the font effect of the second numeric display format can be different from the at least one of the font form, the font color, the background color, the font size and the font effect of the third numeric display format. The aforementioned differences are not limited thereto. Therefore, ranges of the first allowable error value, the second allowable error value and the third allowable error value and the interval of the torque value can be more clearly judged via a difference among the first numeric display format, the second numeric display format and the third numeric display format. The processor 130 can further include an operating value, wherein the operating value is a maximum torque value or a maximum angle value which can be borne by the electronic wrench 100.

Moreover, the prompting unit 140 at least can include a liquid crystal display (LCD) 141, a light-emitting diode (LED) 142, an audio prompting unit 143 and a vibration prompting unit 144. The first numeric display format, the second numeric display format and the third numeric display format can be discriminated from different digital font forms, different font colors, different font sizes or different font effects, and the different digital font forms, the different font colors, the different font sizes and the different font effects can be displayed via the LCD 141. Alternatively, the first numeric display format, the second numeric display format and the third numeric display format can be discriminated from different background colors, and the different background colors can be displayed via the LED 142. Simultaneously, the first numeric display format, the second numeric display format and the third numeric display format can be also discriminated from different audio frequencies, a different loudness, different vibration frequencies or a different vibration intensity, and the different audio frequencies, the different loudness, the different vibration frequencies and the different vibration intensity can be obtained via the audio prompting unit 143 and the vibration prompting unit 144. Therefore, the breadth of application of the electronic wrench 100 of the present disclosure can be promoted. It should be mentioned that the user can select the working status prompt according to demand via the input element 150, that is, a plurality of kinds of the working status prompt can be provided via the electronic wrench 100. Hence, the user can choose every one of the kinds of the working status prompt, and the user can set up the working status prompt according to preference.

Figure 2A:
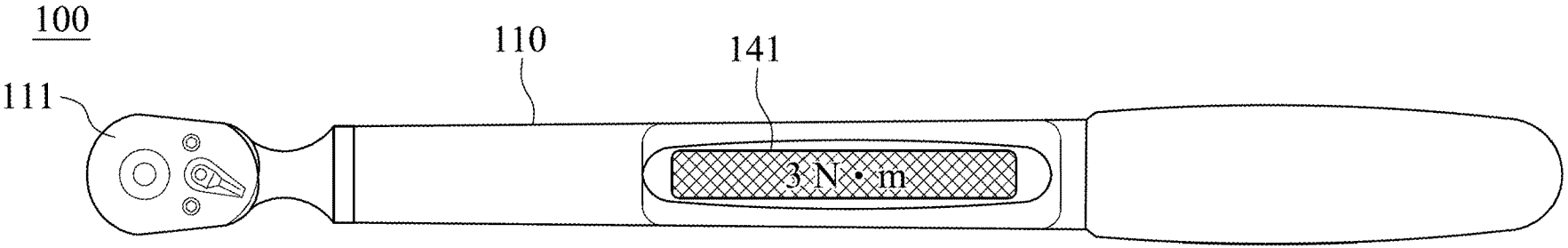
FIG. 2A is a schematic view of a first numeric display format of the electronic wrench according to the embodiment of FIG. 1.
Figure 2B:
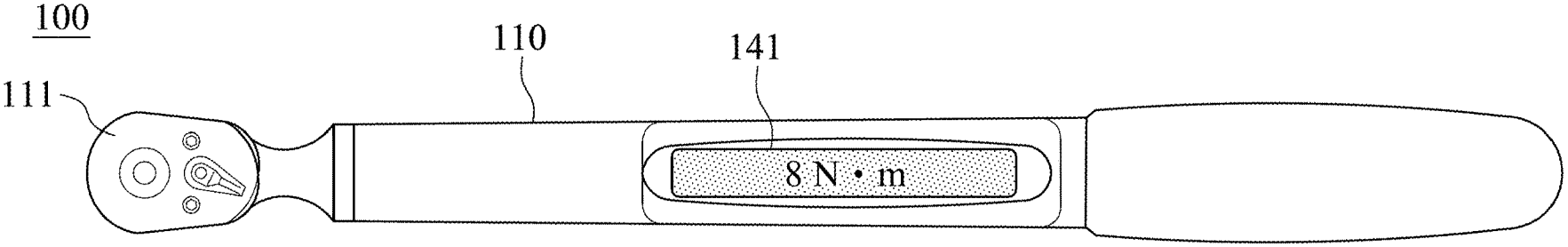
FIG. 2B is a schematic view of a second numeric display format of the electronic wrench according to the embodiment of FIG. 1.
Figure 2C:
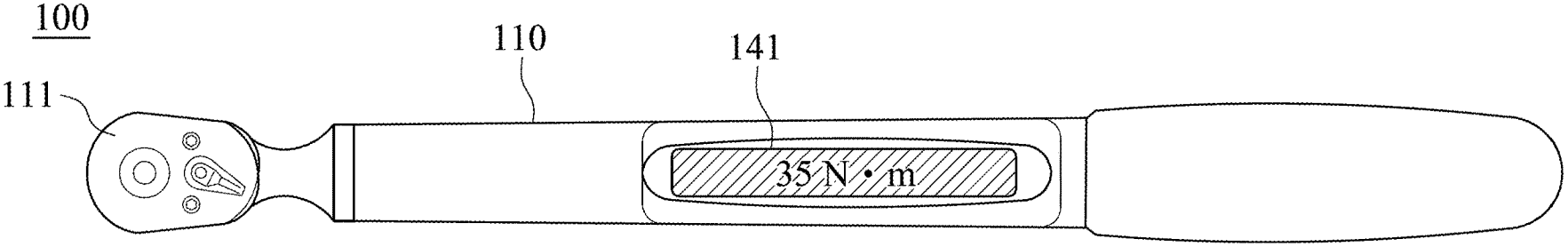
FIG. 2C is a schematic view of a third numeric display format of the electronic wrench according to the embodiment of FIG. 1.
Figure 3A:
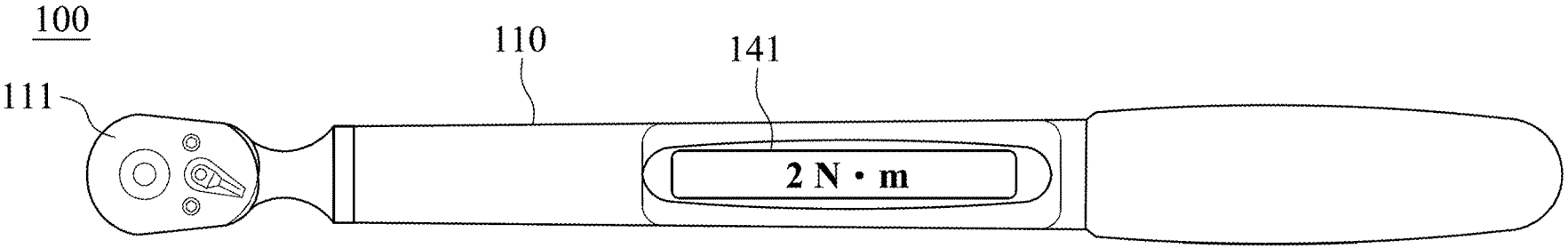
FIG. 3A is another schematic view of the first numeric display format of the electronic wrench according to the embodiment of FIG. 1.
Figure 3B:
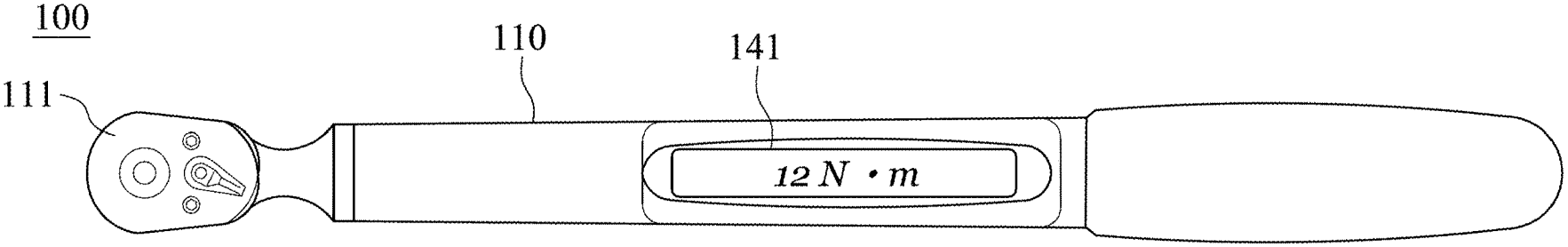
FIG. 3B is another schematic view of the second numeric display format of the electronic wrench according to the embodiment of FIG. 1.
Figure 3C:
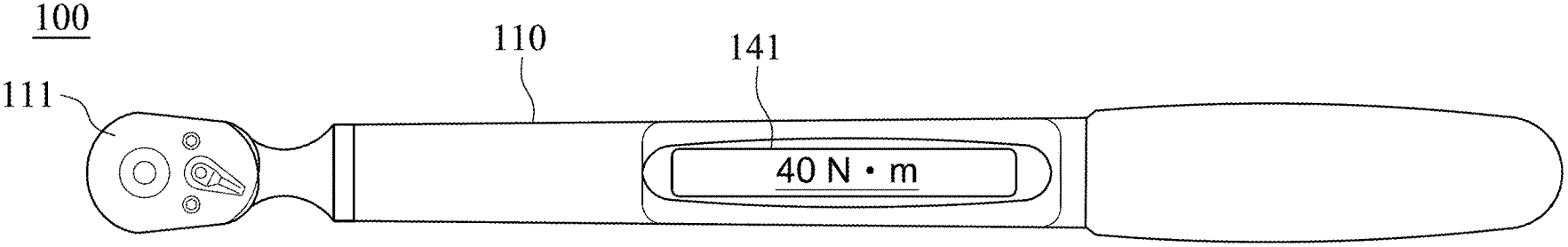
FIG. 3C is another schematic view of the third numeric display format of the electronic wrench according to the embodiment of FIG. 1.
Figure 4A:
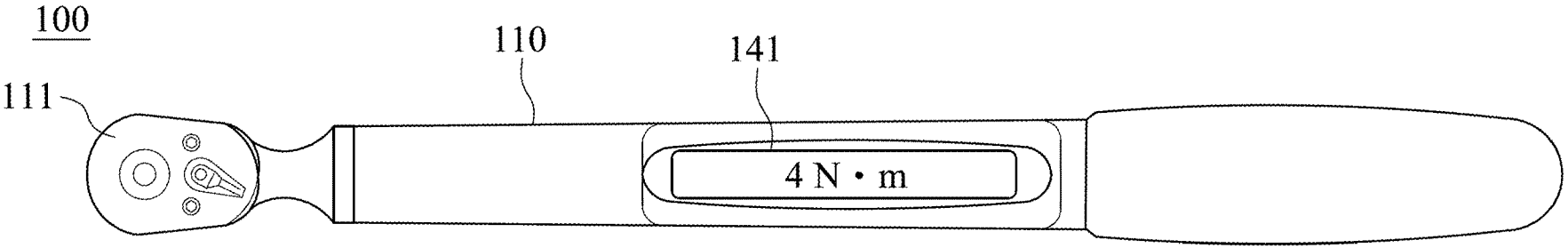
FIG. 4A is another schematic view of the first numeric display format of the electronic wrench according to the embodiment of FIG. 1.
Figure 4B:
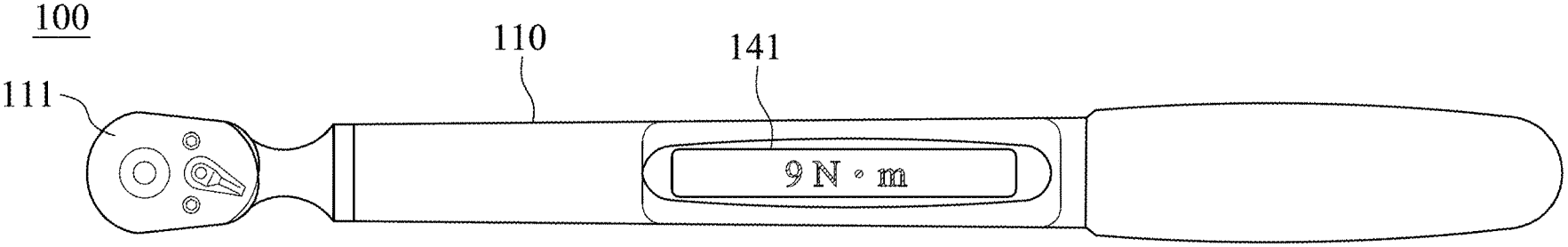
FIG. 4B is another schematic view of the second numeric display format of the electronic wrench according to the embodiment of FIG. 1.
Figure 4C:
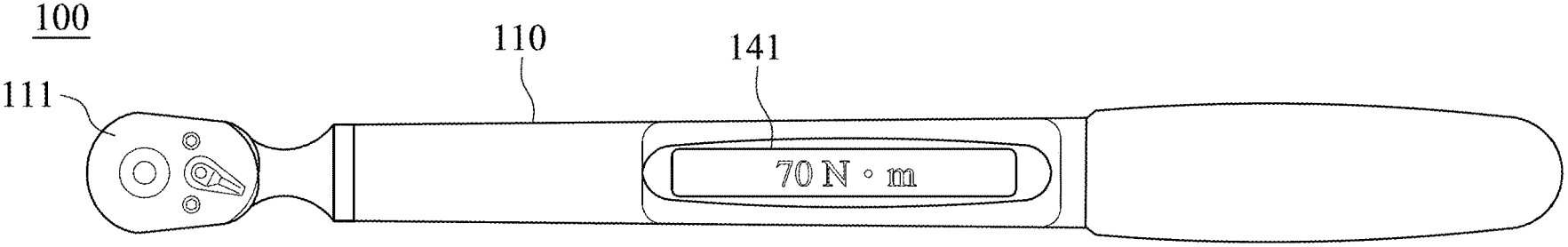
FIG. 4C is another schematic view of the third numeric display format of the electronic wrench according to the embodiment of FIG. 1.
Figure 5A:
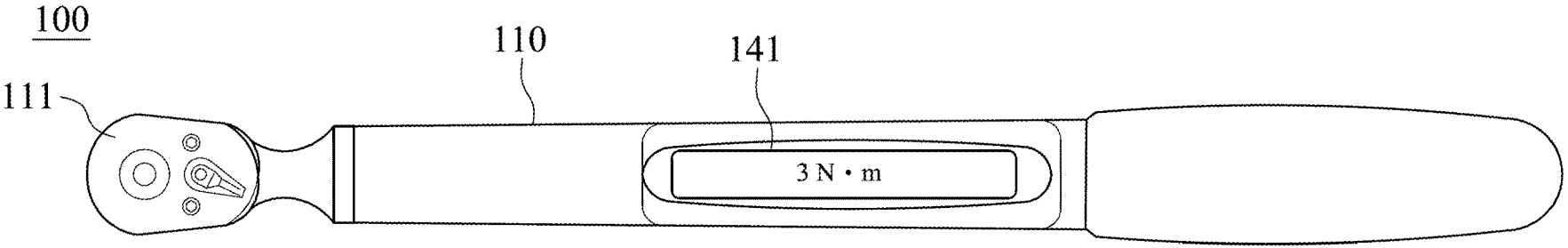
FIG. 5A is another schematic view of the first numeric display format of the electronic wrench according to the embodiment of FIG. 1.
Figure 5B:
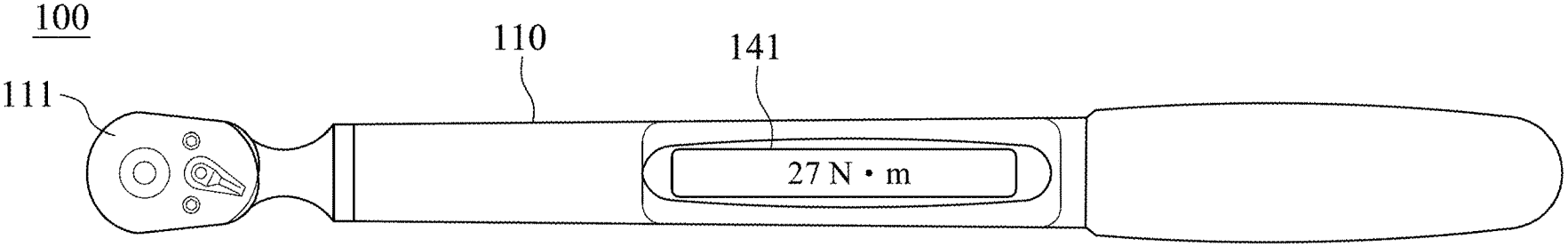
FIG. 5B is another schematic view of the second numeric display format of the electronic wrench according to the embodiment of FIG. 1.
Figure 5C:
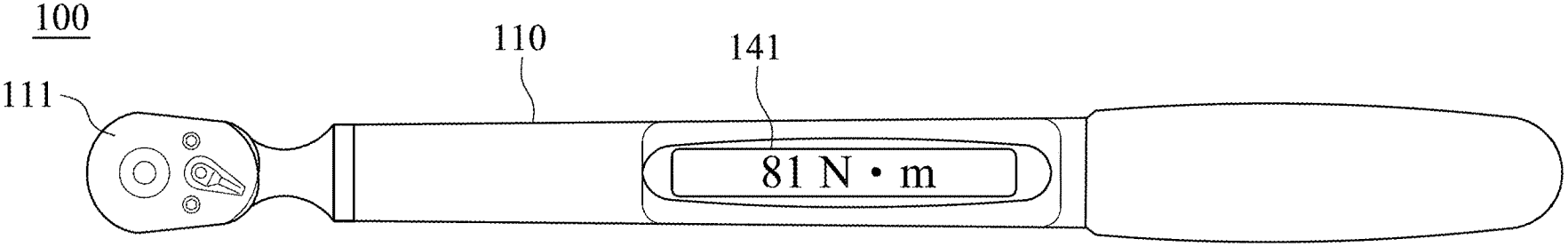
FIG. 5C is another schematic view of the third numeric display format of the electronic wrench according to the embodiment of FIG. 1.
Figure 6A:
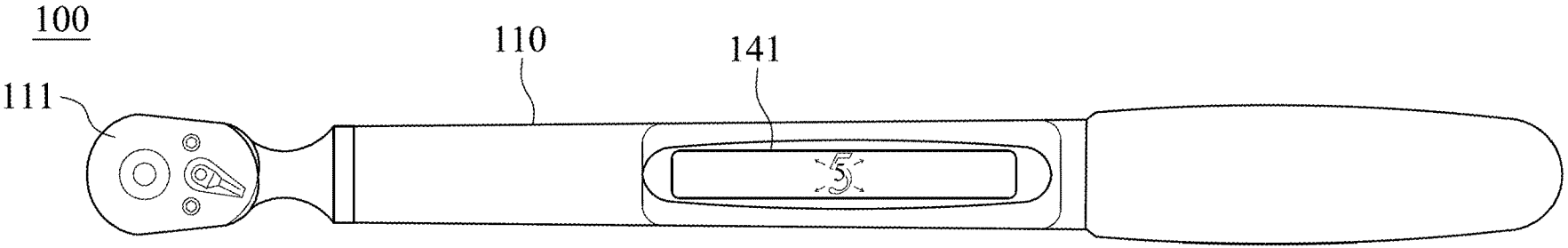
FIG. 6A is another schematic view of the first numeric display format of the electronic wrench according to the embodiment of FIG. 1.
Figure 6B:
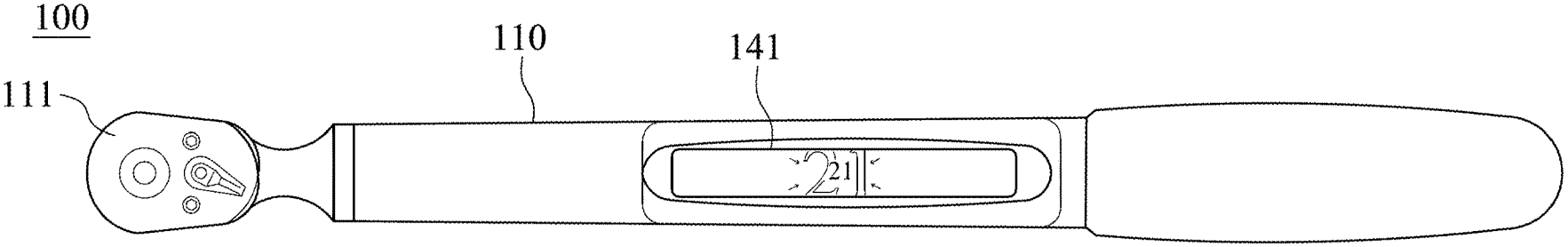
FIG. 6B is another schematic view of the second numeric display format of the electronic wrench according to the embodiment of FIG. 1.
Figure 6C:
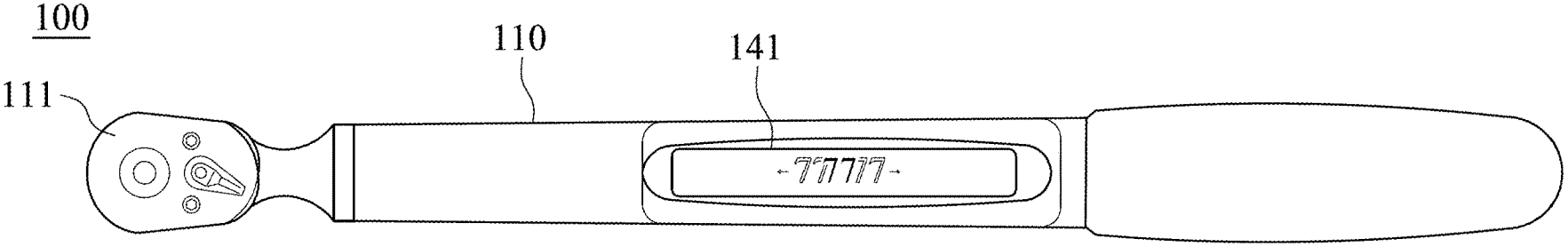
FIG. 6C is another schematic view of the third numeric display format of the electronic wrench according to the embodiment of FIG. 1.

FIG. 2A is a schematic view of a first numeric display format of the electronic wrench 100 according to the embodiment of FIG. 1. FIG. 2B is a schematic view of a second numeric display format of the electronic wrench 100 according to the embodiment of FIG. 1. FIG. 2C is a schematic view of a third numeric display format of the electronic wrench 100 according to the embodiment of FIG. 1. FIG. 3A is another schematic view of the first numeric display format of the electronic wrench 100 according to the embodiment of FIG. 1. FIG. 3B is another schematic view of the second numeric display format of the electronic wrench 100 according to the embodiment of FIG. 1. FIG. 3C is another schematic view of the third numeric display format of the electronic wrench 100 according to the embodiment of FIG. 1. FIG. 4A is another schematic view of the first numeric display format of the electronic wrench 100 according to the embodiment of FIG. 1. FIG. 4B is another schematic view of the second numeric display format of the electronic wrench 100 according to the embodiment of FIG. 1. FIG. 4C is another schematic view of the third numeric display format of the electronic wrench 100 according to the embodiment of FIG. 1. FIG. 5A is another schematic view of the first numeric display format of the electronic wrench 100 according to the embodiment of FIG. 1. FIG. 5B is another schematic view of the second numeric display format of the electronic wrench 100 according to the embodiment of FIG. 1. FIG. 5C is another schematic view of the third numeric display format of the electronic wrench 100 according to the embodiment of FIG. 1. FIG. 6A is another schematic view of the first numeric display format of the electronic wrench 100 according to the embodiment of FIG. 1. FIG. 6B is another schematic view of the second numeric display format of the electronic wrench 100 according to the embodiment of FIG. 1. FIG. 6C is another schematic view of the third numeric display format of the electronic wrench 100 according to the embodiment of FIG. 1. In FIGS. 2A to 2C, the first numeric display format, the second numeric display format and the third numeric display format are discriminated from the different background colors. In FIGS. 3A to 3C, the first numeric display format, the second numeric display format and the third numeric display format are discriminated from the different font forms. In FIGS. 4A to 4C, the first numeric display format, the second numeric display format and the third numeric display format are discriminated from the different font colors. In FIGS. 5A to 5C, the first numeric display format, the second numeric display format and the third numeric display format are discriminated from the different font sizes. In FIGS. 6A to 6C, the first numeric display format, the second numeric display format and the third numeric display format are discriminated from the different font effects.

In detail, the first prompt lower limit value is less than or equal to 5% of the operating value, and the second prompt lower limit value is between 5% to 30% of the operating value, or the second prompt lower limit value is between 5% to 10% of the operating value. The first prompt lower limit value, the second prompt lower limit value, the first allowable error value, the second allowable error value and the third allowable error value can be set via the user, and the prompt upper limit value can be set via the user or equal to the operating value. That is, the user can press the input element 150 to set up the first prompt lower limit value, the second prompt lower limit value, the prompt upper limit value, the first allowable error value, the second allowable error value and the third allowable error value via the input element 150 by repeatedly pressing.

In FIGS. 2A to 2C, the first prompt lower limit value is less than or equal to 5% of the operating value, and the second prompt lower limit value is between 5% to 10% of the operating value. For example, the operating value of the electronic wrench 100 is 100 Nm, a display value range of the first numeric display format is between 0 Nm to 5 Nm (i.e., greater than 0 Nm and less than or equal to 5 Nm), a display value range of the second numeric display format is between 5.1 Nm to 10 Nm (i.e., greater than 5 Nm and less than or equal to 10 Nm), and a display value range of the third numeric display format is between 10.1 Nm to 100 Nm (i.e., greater than 10 Nm and less than or equal to 100 Nm). The first allowable error value of the first numeric display format is ±7%, the second allowable error value of the second numeric display format is ±6%, and the third allowable error value of the third numeric display format is ±4%. The first allowable error value, the second allowable error value and the third allowable error value are verified according to the specification of ISO6789, and the display value range of the first numeric display format, the first allowable error value, the display value range of the second numeric display format, the second allowable error value, the display value range of the third numeric display format and the third allowable error value are not limited thereto. In particular, each of torque values according to the embodiments of FIGS. 2A to 2C is 3 Nm, 8 Nm and 35 Nm. The background color of the LCD 141 of the prompting unit 140 according to the embodiment of FIG. 2A, the background color of the LCD 141 of the prompting unit 140 according to the embodiment of FIG. 2B and the background color of the LCD 141 of the prompting unit 140 according to the embodiment of FIG. 2C are different. It should be mentioned that the different background colors according to the embodiments of FIGS. 2A to 2C are visible in different bottom lines.

In FIGS. 3A to 3C, the first prompt lower limit value is less than or equal to 5% of the operating value, and the second prompt lower limit value is between 5% to 30% of the operating value. For example, the operating value of the electronic wrench 100 is 100 Nm, a display value range of the first numeric display format is between 0 Nm to 5 Nm (i.e., greater than 0 Nm and less than or equal to 5 Nm), a display value range of the second numeric display format is between 5.1 Nm to 30 Nm (i.e., greater than 5 Nm and less than or equal to 30 Nm), and a display value range of the third numeric display format is between 30.1 Nm to 100 Nm (i.e., greater than 30 Nm and less than or equal to 100 Nm). The first allowable error value of the first numeric display format is ±7%, the second allowable error value of the second numeric display format is ±5%, and the third allowable error value of the third numeric display format is ±3%. The first allowable error value, the second allowable error value and the third allowable error value are verified according to the specification of ISO6789, and the display value range of the first numeric display format, the first allowable error value, the display value range of the second numeric display format, the second allowable error value, the display value range of the third numeric display format and the third allowable error value are not limited thereto. In particular, each of torque values according to the embodiments of FIGS. 3A to 3C is 2 Nm, 12 Nm and 40 Nm. The font form of the LCD 141 of the prompting unit 140 according to the embodiment of FIG. 3A, the font form of the LCD 141 of the prompting unit 140 according to the embodiment of FIG. 3B and the font form of the LCD 141 of the prompting unit 140 according to the embodiment of FIG. 3C are different, wherein differences of the font forms can be visible in a boldface, an italics, an underline and a variation of a font, but the differences are not limited thereto.

In FIGS. 4A to 4C, the first prompt lower limit value is less than or equal to 5% of the operating value, and the second prompt lower limit value is between 5% to 10% of the operating value. For example, the operating value of the electronic wrench 100 is 100 Nm, a display value range of the first numeric display format is between 0 Nm to 5 Nm (i.e., greater than 0 Nm and less than or equal to 5 Nm), a display value range of the second numeric display format is between 5.1 Nm to 10 Nm (i.e., greater than 5 Nm and less than or equal to 10 Nm), and a display value range of the third numeric display format is between 10.1 Nm to 100 Nm (i.e., greater than 10 Nm and less than or equal to 100 Nm). The first allowable error value of the first numeric display format is ±10%, the second allowable error value of the second numeric display format is ±6%, and the third allowable error value of the third numeric display format is ±4%. The first allowable error value, the second allowable error value and the third allowable error value are verified according to the specification of ISO6789, and the display value range of the first numeric display format, the first allowable error value, the display value range of the second numeric display format, the second allowable error value, the display value range of the third numeric display format and the third allowable error value are not limited thereto. In particular, each of torque values according to the embodiments of FIGS. 4A to 4C is 4 Nm, 9 Nm and 70 Nm. The font color of the LCD 141 of the prompting unit 140 according to the embodiment of FIG. 4A, the font color of the LCD 141 of the prompting unit 140 according to the embodiment of FIG. 4B and the font color of the LCD 141 of the prompting unit 140 according to the embodiment of FIG. 4C are different.

In FIGS. 5A to 5C, the first prompt lower limit value is less than or equal to 5% of the operating value, and the second prompt lower limit value is between 5% to 30% of the operating value. For example, the operating value of the electronic wrench 100 is 100 Nm, a display value range of the first numeric display format is between 0 Nm to 5 Nm (i.e., greater than 0 Nm and less than or equal to 5 Nm), a display value range of the second numeric display format is between 5.1 Nm to 30 Nm (i.e., greater than 5 Nm and less than or equal to 30 Nm), and a display value range of the third numeric display format is between 30.1 Nm to 100 Nm (i.e., greater than 30 Nm and less than or equal to 100 Nm). The first allowable error value of the first numeric display format is ±7%, the second allowable error value of the second numeric display format is ±6%, and the third allowable error value of the third numeric display format is ±4%. The first allowable error value, the second allowable error value and the third allowable error value are verified according to the specification of ISO6789, and the display value range of the first numeric display format, the first allowable error value, the display value range of the second numeric display format, the second allowable error value, the display value range of the third numeric display format and the third allowable error value are not limited thereto. In particular, each of torque values according to the embodiments of FIGS. 5A to 5C is 3 Nm, 27 Nm and 81 Nm. The font size of the LCD 141 of the prompting unit 140 according to the embodiment of FIG. 5A, the font size of the LCD 141 of the prompting unit 140 according to the embodiment of FIG. 5B and the font size of the LCD 141 of the prompting unit 140 according to the embodiment of FIG. 5C are different.

In FIGS. 6A to 6C, the first prompt lower limit value is less than or equal to 5% of the operating value, and the second prompt lower limit value is between 5% to 30% of the operating value. For example, the operating value of the electronic wrench 100 is 100 Nm, a display value range of the first numeric display format is between 0 Nm to 5 Nm (i.e., greater than 0 Nm and less than or equal to 5 Nm), a display value range of the second numeric display format is between 5.1 Nm to 30 Nm (i.e., greater than 5 Nm and less than or equal to 30 Nm), and a display value range of the third numeric display format is between 30.1 Nm to 100 Nm (i.e., greater than 30 Nm and less than or equal to 100 Nm). The first allowable error value of the first numeric display format is ±7%, the second allowable error value of the second numeric display format is ±6%, and the third allowable error value of the third numeric display format is ±4%. The first allowable error value, the second allowable error value and the third allowable error value are verified according to the specification of ISO6789, and the display value range of the first numeric display format, the first allowable error value, the display value range of the second numeric display format, the second allowable error value, the display value range of the third numeric display format and the third allowable error value are not limited thereto. In particular, each of torque values according to the embodiments of FIGS. 6A to 6C is 5 Nm, 21 Nm and 77 Nm. The font effect of the LCD 141 of the prompting unit 140 according to the embodiment of FIG. 6A, the font effect of the LCD 141 of the prompting unit 140 according to the embodiment of FIG. 6B and the font effect of the LCD 141 of the prompting unit 140 according to the embodiment of FIG. 6C are different, wherein differences of the font effects can be visible in resizing and swaying, but the differences are not limited thereto.

The processor 130 can further include a memory 131, and the sensing information value, the first prompt lower limit value, the second prompt lower limit value and the prompt upper limit value can be saved via the memory 131. Therefore, the memory 131 is favorable for the user to read a previous usage status when the user next uses the electronic wrench 100.

Figure 7:
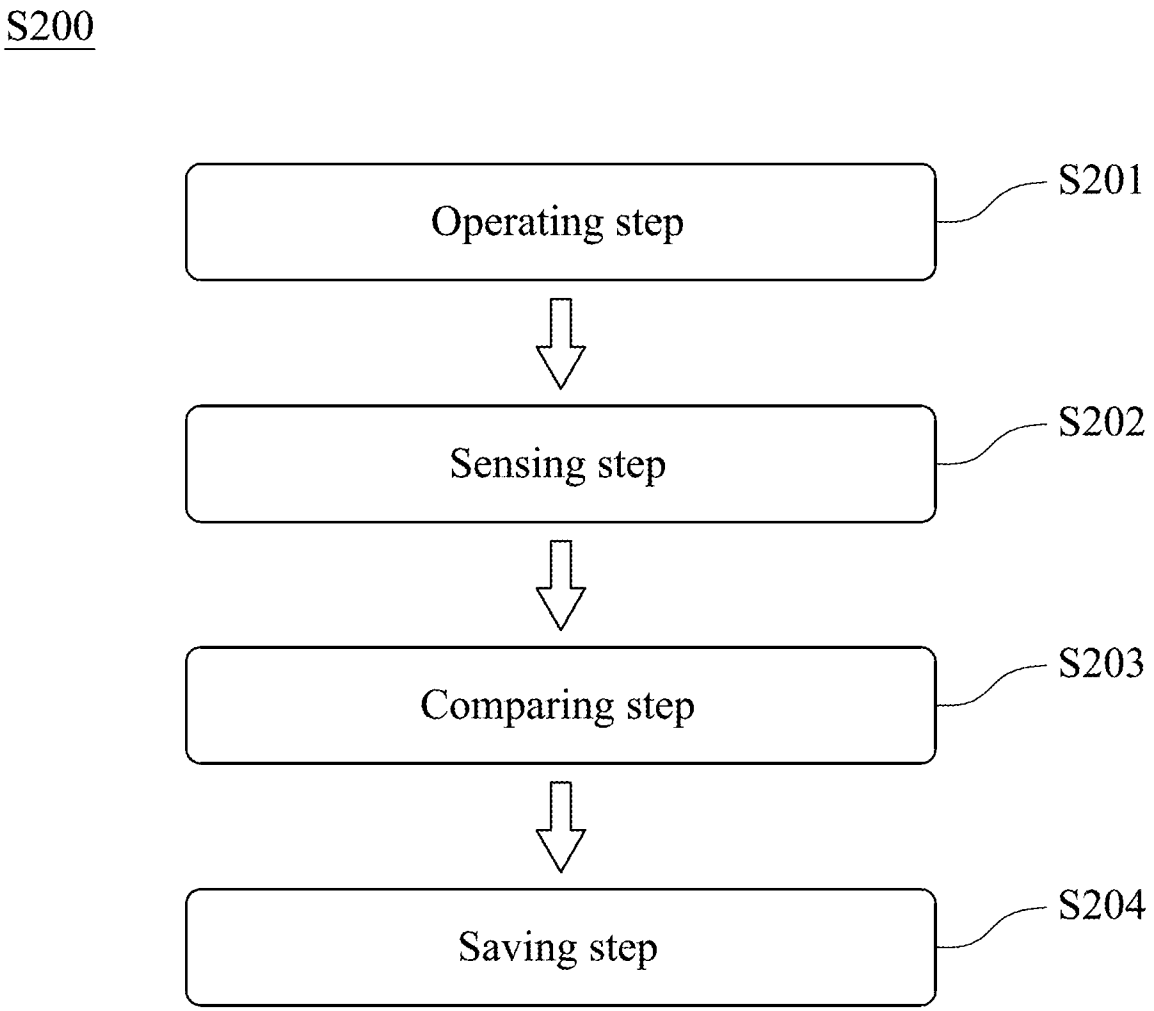
FIG. 7 is a step flow chart of a prompting method of an electronic wrench according to an embodiment of the present disclosure.

FIG. 7 is a step flow chart of a prompting method of an electronic wrench S200 according to an embodiment of the present disclosure, wherein the prompting method of the electronic wrench S200 can be performed with the electronic wrench 100 according to the aforementioned embodiment of FIG. 1, but is not limited thereto. In FIG. 7, the prompting method of the electronic wrench S200 includes an operating step S201, a sensing step S202, a comparing step S203 and a saving step S204.

In the operating step S201, the working head 111 of the electronic wrench 100 is operated on a workpiece (not shown). In the sensing step S202, the working status of the working head 111 is sensed via the sensing element 120 to generate the sensing signal, and the sensing signal includes the sensing information value. In the comparing step S203, the sensing information value is compared to the first prompt lower limit value and the second prompt lower limit value to provide the working status prompt. When the sensing information value is less than or equal to the first prompt lower limit value, the working status prompt is the first numeric display format, and the range of the first numeric display format has the first allowable error value. When the sensing information value is greater than the first prompt lower limit value and less than or equal to the second prompt lower limit value, the working status prompt is the second numeric display format, and the range of the second numeric display format has the second allowable error value.

In the comparing step S203, the sensing information value can be further compared to the prompt upper limit value to provide the working status prompt. When the sensing information value is greater than the second prompt lower limit value and less than or equal to the prompt upper limit value, the working status prompt is the third numeric display format, and the range of the third numeric display format has the third allowable error value.

In the saving step S204, the sensing information value, the first prompt lower limit value, the second prompt lower limit value and the prompt upper limit value are saved via the memory 131 of the processor 130. Therefore, the memory 131 is favorable for the user to read the previous usage status when the user next uses the electronic wrench 100.

In detail, when the working head 111 of the electronic wrench 100 is operated on the workpiece, the working status of the working head 111 is sensed via the sensing element 120 and the sensing signal is generated, and the sensing signal is transferred to the processor 130. The sensing signal can include the sensing information value, and the processor 130 can include the first prompt lower limit value, the second prompt lower limit value, the prompt upper limit value and the operating value, wherein the operating value is the maximum torque value or the maximum angle value which can be borne by the electronic wrench 100. After the sensing signal received via the processor 130, the sensing information value is compared to each of the first prompt lower limit value, the second prompt lower limit value and the prompt upper limit value via the processor 130, and a comparing result is then generated. The working status prompt can be provided according to the comparing result via the prompting unit 140 to provide the user the working status of the working head 111.

In the comparing step S203, the first prompt lower limit value and the second prompt lower limit value can be set via the user, and the prompt upper limit value can be set via the user or equal to the operating value. Further, the user can set up the first prompt lower limit value, the second prompt lower limit value and the prompt upper limit value via the input element 150 by repeatedly pressing. In detail, when the sensing information value is less than or equal to the first prompt lower limit value, the working status prompt is visible in the first numeric display format, and the range of the first numeric display format has the first allowable error value; when the sensing information value is greater than the first prompt lower limit value and less than or equal to the second prompt lower limit value, the working status prompt is visible in the second numeric display format, and the range of the second numeric display format has the second allowable error value; when the sensing information value is greater than the second prompt lower limit value and less than or equal to the prompt upper limit value, the working status prompt is visible in the third numeric display format, and the range of the third numeric display format has the third allowable error value. Moreover, at least one of the font form, the font color, the background color, the font size and the font effect of the first numeric display format can be different from at least one of the font form, the font color, the background color, the font size and the font effect of the second numeric display format, the at least one of the font form, the font color, the background color, the font size and the font effect of the first numeric display format can be different from at least one of the font form, the font color, the background color, the font size and the font effect of the third numeric display format, and the at least one of the font form, the font color, the background color, the font size and the font effect of the second numeric display format can be different from the at least one of the font form, the font color, the background color, the font size and the font effect of the third numeric display format, but the aforementioned display differences are not limited thereto.

In detail, the sensing information value is compared to each of the first prompt lower limit value, the second prompt lower limit value and the prompt upper limit value via the processor 130, and the comparing result is then generated. Different working status prompts can be provided according to the comparing result via the prompting unit 140. Therefore, the user can judge the working status of the working head 111 according to the different working status prompts.

In summary, an operating status of the electronic wrench can be clearly judged by the working status prompt provided by the electronic wrench and the prompting method thereof of the present disclosure. Moreover, not only is a visual difference obtained via the LCD and the LED of the prompting unit, but an auditory difference and a tactile difference can be obtained via the audio prompting unit and the vibration prompting unit of the prompting unit. The working status prompt of the electronic wrench can be set up according to the user's preference and a convenience. Therefore, the user can clearly judge the operating status of the electronic wrench, and the breadth of application of the electronic wrench can be extended.

The foregoing description, for purpose of explanation, has been described with reference to specific examples. It is to be noted that Tables show different data of the different examples; however, the data of the different examples are obtained from experiments. The examples were chosen and described in order to best explain the principles of the disclosure and its practical applications, to thereby enable others skilled in the art to best utilize the disclosure and various examples with various modifications as are suited to the particular use contemplated. The examples depicted above and the appended drawings are exemplary and are not intended to be exhaustive or to limit the scope of the present disclosure to the precise forms disclosed. Many modifications and variations are possible in view of the above teachings.

What is claimed is:

1. An electronic wrench, comprising:

a main body comprising a working head;

at least one sensing element disposed on the main body, wherein the at least one sensing element is configured to sense a working status of the working head to generate a sensing signal, and the sensing signal comprises at least one sensing information value;

a processor electrically connected to the at least one sensing element, and the processor comprising a first prompt lower limit value and a second prompt lower limit value; and at least one prompting unit electronically connected to the processor, wherein the at least one prompting unit is configured to provide at least one working status prompt;

wherein when the at least one sensing information value is less than or equal to the first prompt lower limit value, the at least one working status prompt is visible in a first numeric display format, and a range of the first numeric display format has a first allowable error value;

wherein when the at least one sensing information value is greater than the first prompt lower limit value and less than or equal to the second prompt lower limit value, the at least one working status prompt is visible in a second numeric display format, and a range of the second numeric display format has a second allowable error value;

wherein the first numeric display format is different from the second numeric display format.

2. The electronic wrench of claim 1, wherein at least one of a font form, a font color, a background color, a font size and a font effect of the first numeric display format is different from at least one of a font form, a font color, a background color, a font size and a font effect of the second numeric display format.

3. The electronic wrench of claim 1, wherein the processor further comprises an operating value, and the first prompt lower limit value is less than or equal to 5% of the operating value.

4. The electronic wrench of claim 1, wherein the processor further comprises an operating value, and the second prompt lower limit value is between 5% to 30% of the operating value.

5. The electronic wrench of claim 1, wherein the processor further comprises an operating value, and the second prompt lower limit value is between 5% to 10% of the operating value.

6. The electronic wrench of claim 1, wherein the processor further comprises a prompt upper limit value, when the at least one sensing information value is greater than the second prompt lower limit value and less than or equal to the prompt upper limit value, the working status prompt is visible in a third numeric display format, a range of the third numeric display format has a third allowable error value, and the third numeric display format is different from the first numeric display format and the second numeric display format.

7. The electronic wrench of claim 6, wherein the first prompt lower limit value, the second prompt lower limit value, the first allowable error value, the second allowable error value and the third allowable error value are set via a user, and the prompt upper limit value is set via the user or equal to an operating value.

8. The electronic wrench of claim 6, wherein the third allowable error value is less than the second allowable error value, and the second allowable error value is less than the first allowable error value.

9. A prompting method of an electronic wrench, comprising:

an operating step, wherein a working head of the electronic wrench is operated on a workpiece;

a sensing step, wherein a working status of the working head is sensed via at least one sensing element to generate a sensing signal, and the sensing signal comprises at least one sensing information value; and a comparing step, wherein the at least one sensing information value is compared to a first prompt lower limit value and a second prompt lower limit value to provide a working status prompt;

wherein when the at least one sensing information value is less than or equal to the first prompt lower limit value, the working status prompt is a first numeric display format, and a range of the first numeric display format has a first allowable error value;

wherein when the at least one sensing information value is greater than the first prompt lower limit value and less than or equal to the second prompt lower limit value, the working status prompt is a second numeric display format, and a range of the second numeric display format has a second allowable error value.

10. The prompting method of the electronic wrench of claim 9, wherein the at least one sensing information value is further compared to a prompt upper limit value in the comparing step to provide the working status prompt, when the at least one sensing information value is greater than the second prompt lower limit value and less than or equal to the prompt upper limit value, the working status prompt is a third numeric display format, and a range of the third numeric display format has a third allowable error value.

* * * * *